United States Patent [19]

Nameny et al.

[11] Patent Number: 4,579,060

[45] Date of Patent: Apr. 1, 1986

[54] TIE EXCHANGER WITH COMPOUND CLAMPING HEAD

[75] Inventors: Frank J. Nameny, Rogers; Lenard L. Lawrence, Loretto, both of Minn.

[73] Assignee: Loram Maintenance of Way, Inc., Hamel, Minn.

[21] Appl. No.: 482,889

[22] Filed: Apr. 6, 1983

[51] Int. Cl.[4] ..... E01B 29/06; E01B 29/09

[52] U.S. Cl. ..... 104/9; 294/87.1

[58] Field of Search ..... 104/9; 294/87 R; 414/736

[56] References Cited

U.S. PATENT DOCUMENTS

| | | | |
|---|---|---|---|
| 3,160,114 | 12/1964 | Stewart | 104/9 |
| 3,780,664 | 12/1973 | Holley et al. | 104/9 |
| 4,018,165 | 4/1977 | Bryan, Jr. | 104/9 |

*Primary Examiner*—Robert B. Reeves
*Assistant Examiner*—Dennis C. Rodgers
*Attorney, Agent, or Firm*—Dorsey & Whitney

[57] ABSTRACT

Railroad right-of-way maintenance equipment and method for removing old ties from beneath railroad rails and replacing them with new ties, characterized by a compound clamping head. The compound clamping head simultaneously grips a new tie and an old tie while withdrawing the old tie from beneath the rails, releases or discards the old tie at the end of the withdrawal stroke, and inserts the new tie in place of the old on the consecutive reciprocal return stroke. The invention also includes a kick-out feature for moving the old tie beyond the end of the withdrawal stroke for release or discard of the old tie.

14 Claims, 10 Drawing Figures

TIE EXCHANGER WITH COMPOUND CLAMPING HEAD

BACKGROUND OF INVENTION

1. Field of the Invention

The present invention is in the field of railroad right-of-way maintenance. More particularly, the invention relates to apparatus and a method for removing old broken or rotted ties from beneath railroad rails and inserting a new tie in place of the old, with minimum manual labor and maximum efficiency.

2. Description of Prior Art

Railroad right-of-way maintenance has historically been a labor intensive activity. Large crews with picks, shovels, axes, crowbars and sledge hammers doing demanding and tedious manual labor have characterized the work of both right-of-way preparation and track laying, and maintenance for many years. In roughly the last thirty years machines have been designed and built to remove much of the hand labor from various railroad right-of-way activities, including machines for the removal and replacement of old ties.

The earliest known disclosure of such apparatus is Burk (U.S. Pat. No. 1,015,475). More recent U.S. Pat. Nos. including Fox (2,828,699), Kershaw (2,908,228), Perazzoli (3,000,325), Blix, Jr. et al. (3,294,033), Moorehead, jr. et al. (3,314,374), Kershaw (3,675,580), Peppin et al. (3,698,324), Holley et al. (3,780,664) and Dieringer et al. (3,964,397), also disclose such apparatus.

While these patents teach the mechanical removal and replacement of old ties from beneath the rails, and disclose apparatus that eliminates much of the manual labor, each prior art patent requires that the old tie be removed in one operation and the new tie inserted in another distinct operation. The two operations are not consecutive or reciprocal. Typically, the prior art apparatus requires a separate handling of the old tie, on the one hand, and the new tie, on the other hand, often with separate machines and separate crews. The prior art apparatus thus requires two separate gripping operations and two passes of the machinery, one for removing the old tie and the other for inserting the new tie. Thus two passes and four strokes per tie replaced are required in order to remove and discard the old tie and pick up and insert the new tie. More particularly, the withdrawal and insertion strokes required in the prior art are pulling the old tie along its longitudinal axis from beneath the rail (stroke one) and discarding or releasing it, returning to grasp a new tie located on the apparatus or the rails transversely above the old tie (stroke two), gripping the new tie and moving it transversely along its longitudinal axis to a position off to the side of the rails (stroke three), and then inserting the new tie beneath the rails by moving it once again in a path along its longitudinal axis to replace the old tie with the new (stroke four).

The disadvantage in the prior art is the time required to carry out two separate removing and replacement operations. Another disadvantage of prior art apparatus such as Peppin et al. (U.S. Pat. No. 3,698,324) and Holley et al. (U.S. Pat. No. 3,780,604) is that the old tie cannot be released or discarded sufficiently remote from the rails to be well out of the path of the new tie as it is inserted into the position of the old tie, to thereby replace the old tie.

SUMMARY OF THE INVENTION

The present invention provides for simultaneously gripping or clamping the new tie and the old tie, and removal of the old tie and insertion of the new tie in two consecutive reciprocal strokes. This improvement is intended to result in the removal of old ties and replacement of old ties with new ties at the rate of 3–5 ties per minute, which is a significant improvement over the prior art rate.

Thus, one of the objects of the invention is to increase the speed of removal of old ties and replacement of old ties with new ties, with no increase in labor required.

In addition, the present invention provides for releasing the old tie well clear of the railroad bed and well clear of the path for insertion of the new tie. This is accomplished by moving or "kicking-out" the old tie at the end of the stroke that withdraws the old tie. The old tie is thus "kicked out" beyond the end of the withdrawal stroke before release or discard, so that, when discarded, it is well removed from the insertion path of the new tie.

Thus, another object of the invention is to release or discard the old tie a distance more remote from the bed than the prior art, without increased labor and without requiring significant additional time.

These objects, as well as others, are achieved by a unique compound clamping head assembly, that allows simultaneous clamping or gripping of the new tie and the old tie, withdrawal of the old tie while simultaneously gripping the new tie, release or discard of the old tie, and insertion of the new tie on the consecutive reciprocal (return) stroke of the clamping head assembly.

The compound clamping head assembly includes first clamping means for grasping a new tie near its end and second clamping means beneath the first clamping means for simultaneously grasping the old tie. The new tie is positioned above the old tie and above the rails, either resting on the rails or on the wheel mounted frame of the apparatus, for the simultaneous grasping operation. Means in the form of a boom member and a jib member pivotably mounted to the boom member, each pivotable about a horizontal axis, with the boom member mounted for pivotal movement about a vertical axis as well on the wheel mounted frame of the apparatus, is provided for moving the clamping head assembly, which is pivotably mounted to the jib member, away from and toward the rails. This movement provides for withdrawal of the old tie from beneath the rails while simultaneously grasping the new tie on the withdrawal stroke, and insertion of the new tie on the reciprocal return stroke. Means is provided for releasing or discarding the old tie after the withdrawal stroke and before the insertion stroke.

The present invention also includes means for pivoting the second clamping means, with respect to the clamping head assembly, about a horizontal axis, to kick-out the old tie beyond the end of the withdrawal stroke before release or discard of the old tie. The old tie can therefore be discarded well away from the bed and the insertion path of the new tie.

The method of the invention is characterized by removing the old tie and inserting the new tie, respectively, in consecutive reciprocal strokes. The method includes the steps of simultaneously grasping a new tie near its end and grasping the old tie disposed beneath the new. The old tie is then withdrawn from beneath the rails along a path transverse to the rails and substantially along the longitudinal axis of the old tie, while simultaneously grasping and moving the new tie on a parallel path. The old tie is then released or discarded. The new tie is then inserted in place of the old on the consecutive reciprocal (return) stroke by movement in a path substantially along the longitudinal axis of the new tie, beneath the rails, to thereby replace the old tie with the new tie.

An additional feature of the method of the invention is the step, after withdrawal and before release or discard of the old tie, of moving the old tie further from beneath the rails beyond the end or the withdrawal stroke to thereby kick-out the old tie for release or discard well removed from and well out of the path of the new tie on the return (insertion) stroke, and well removed from the road bed for ease of pick-up and/or disposal.

DESCRIPTION OF DRAWINGS

FIG. 2 shows the boom, jib and clamping head assembly in side view in their starting position, simultaneously grasping an old tie and a new tie. The boom, jib and clamping head assembly also appear to the extreme right in FIG. 2 in their withdrawn and "kicked-out" position immediately before release or discard of the old tie.

FIG. 6A shows the rearmost portion of the section, as viewed in FIG. 4, and FIG. 6B shows the nearest portion of the section.

FIG. 7 is a perspective view of a clamping head assembly that includes all the features of the preferred embodiment except for the kick-out feature.

FIG. 8 is a front end view of the clamping head assembly of FIG. 7. In FIG. 8 the opposing wing clamps for grasping an old tie are shown in their closed, clamping position, shown in dotted lines engaging the opposite sides of an old tie in dotted lines. The wing clamps are shown in a released but not fully opened position in solid lines.

FIG. 9 is also a front end view of the clamping head assembly of FIG. 7 with the opposing wing clamps fully opened so that they do not extend below the bottom of the new tie. In this position they are out of the way when the clamping head is moved to insert a new tie.

DESCRIPTION OF THE PREFERRED EMBODIMENT

The Primary Structural Members

Figure 1:
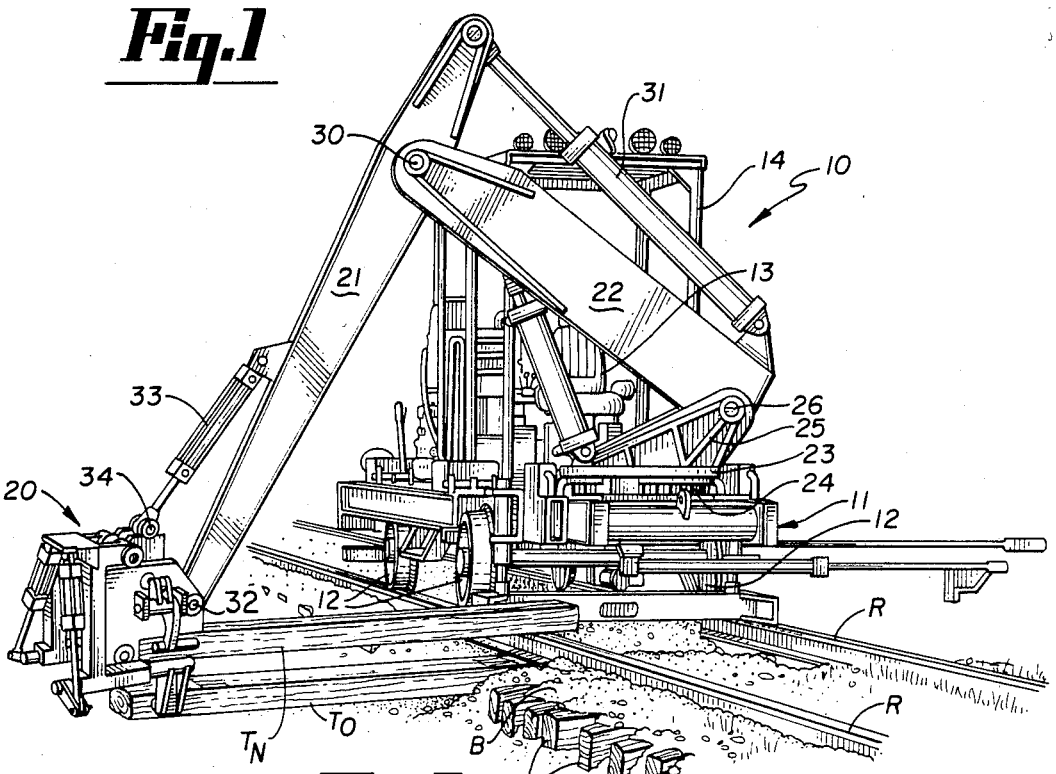
FIG. 1 is a perspective view of the preferred embodiment of the tie exchanger of the present invention, and shows the exchanger in working position on the rails with a new tie in grasp and an old tie substantially withdrawn from beneath the rails.

The preferred embodiment of the present invention is shown in FIGS. 1–4. With reference to FIG. 1, the tie exchanger 10 of the preferred embodiment includes a frame 11 mounted on wheels 12, which engage rails, R. Ties, T, are disposed beneath the rails, R, embedded in ballast, B. In FIG. 1, tie exchanger 10 is shown simultaneously grasping a new tie, $T_N$, and an old tie, $T_O$.

Frame 11 serves to mount seat 13 for the operator, a protective cab 14, and a engine (not clearly shown) for moving the tie exchanger along the rails and for providing hydraulic power for operation. Suitable standard hydraulic circuitry and valving (not shown) is provided for operation of the various hydraulic functions which are described below.

The other major components of tie exchanger 10 are the clamping head assembly 20, the jib member 21, and boom member 22. Boom member 22 is mounted to frame 11 for pivotal movement about both a vertical axis and a horizontal axis. The means mounting boom member 22 for movement about a vertical axis includes turret 23, turret gear 24 and turret mounting bracket 25, welded to turret 23. Boom member 22 is mounted to turret mounting bracket 25 by means of pin 26 for pivotal movement about the axis of pin 26, designated the first horizontal axis. Hydraulic boom cylinder 27 extends from turret 23 to boom member 22 and serves to pivot and control the position of boom member 22 about the (first) horizontal axis of pin 26, in conventional manner.

Jib member 21 is pivotally mounted to boom member 22 by means of pin 30 for movement about the axis of pin 30, designated the second horizontal axis. A large jib cylinder 31 extends from the base end of boom member 22 to the upper end of jib member 21 and serves to pivot and control the position of jib member 21 about the (second) horizontal axis of pin 30.

Clamping head assembly 20 is pivotally mounted to the lower end of jib member 21 for movement about the axis of pin 32, designated the third horizontal axis. Clamping head assembly tilt cylinder 33 extends from an intermediate point on jib member 21 to the top of clamping head assembly 20 at pin 34 to pivot and control the position of clamping head assembly 20 about the (third) horizontal axis of pin 32.

Together, boom member 22, jib member 21 and clamping head assembly 20, along with their respective hydraulic cylinders 27, 31 and 33, serve as means for controlling the position of clamping head assembly 20 to withdraw old ties, $T_O$, and insert new ties, $T_N$. For this purpose, through the turret, boom and jib arrangement described, clamping head assembly 20 can be swung about a vertical axis, moved up and down and moved toward and away from rails, R, and in any direction that is the resultant of any of the foregoing component motions, as controlled by conventional hydraulic circuitry and valving operated by an operator seated on seat 13 of tie exchanger 10.

The Compound Claming Head

The design and construction of the compound clamping head assembly that characterizes the preferred embodiment of the present invention is best explained with reference to FIGS. 3–6. Clamping head assembly 20 includes side plates 40 and 41 and top plate 42 welded thereto. A pair of upstanding brackets or gusset plates 43 and 44 are welded to and extend upwardly from top plate 42 to mount collars 45 and 46. Side plates 40 and 41 also serve to mount collars 47 and 48. Clamping head assembly 20 is pivotally mounted to jib member 21 by means of pin 32 journalled in collars 47 and 48. The axis of pin 32 is the third horizontal axis. Pin 34, journaled in collars 45 and 46, serves to mount the piston end of hydraulic cylinder 33 to clamping head assembly 20.

Means is provided for clamping or grasping a new tie in the form of shoe 50, which is made up of side plate 51, top plate 52 and end plate 53. Shoe 50 serves as a guide for engaging the new tie and clamping it into a secure position utilizing lower jaw clamp 55 and side jaw clamp 56. Lower jaw clamp 55 is comprised of parallel spaced rocker arm side plates 57 and 58 which are pivotally mounted on pin 59, which is journalled in collars 60 and 61 welded to side plates 40 and 41, respectively of clamping head assembly 20. Lower jaw 55 includes a new tie engaging bar 62, which may, if desired, be provided with teeth to more securely engage new tie, $T_N$. Lower jaw hydraulic cylinder 64 extends from brackets 65 and 66, suspended from top plate 42, to pin 67 mounted between lower jaw rocker arm side plates 57 and 58. Thus, the operation of hydraulic cylinder 64 causes lower jaw 55 to rock or pivot about the axis of pin 59, designated the fourth horizontal axis, to thereby move bar 62 into and out of engagement with new tie, $T_N$, to force new tie, $T_N$, against top plate 52 of shoe 50, and to release new tie, $T_N$, respectively.

Figure 4:
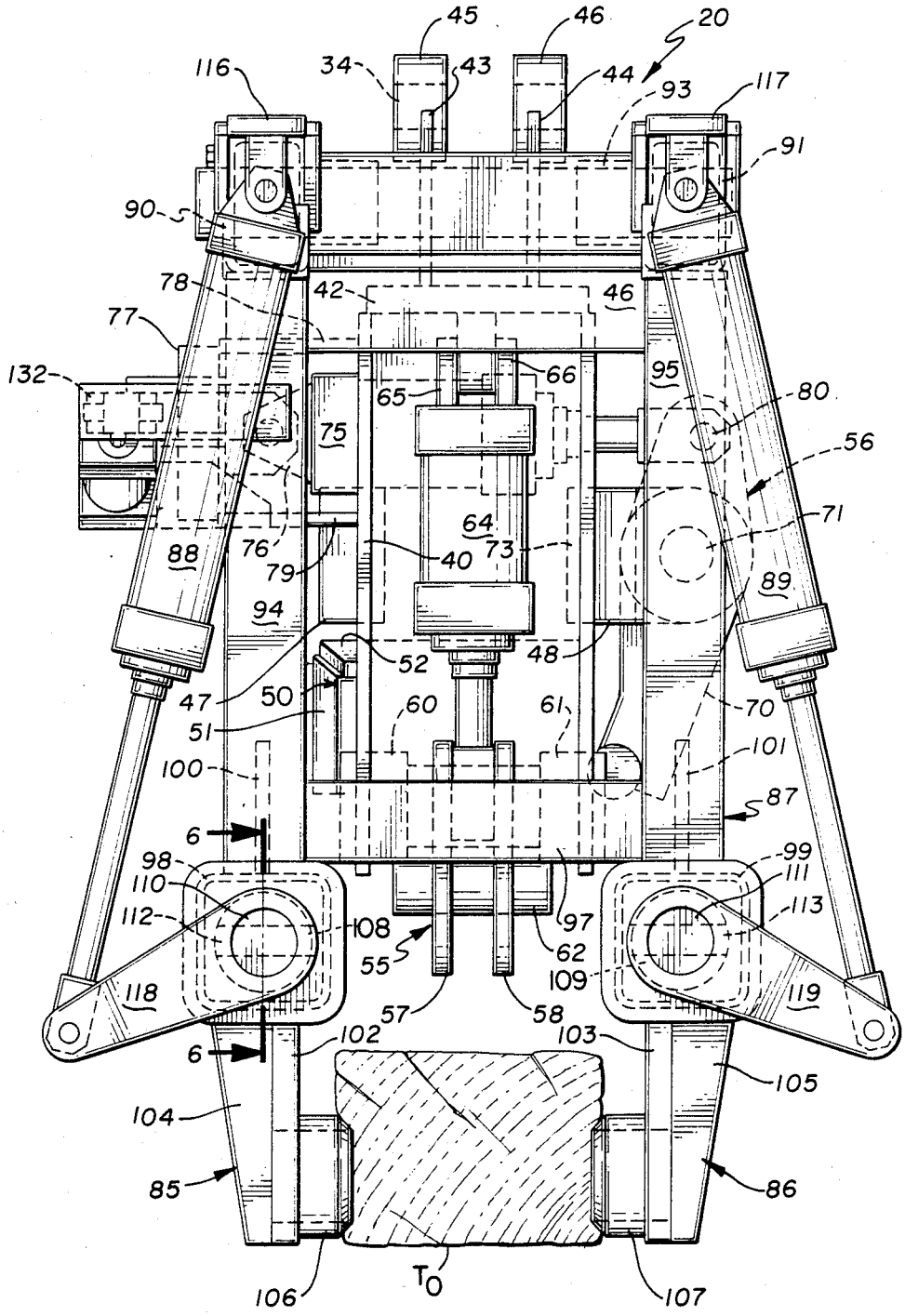
FIG. 4 is a front end view of the clamping head assembly of FIG. 3 (viewed from the right in FIG. 3).
Figure 5:
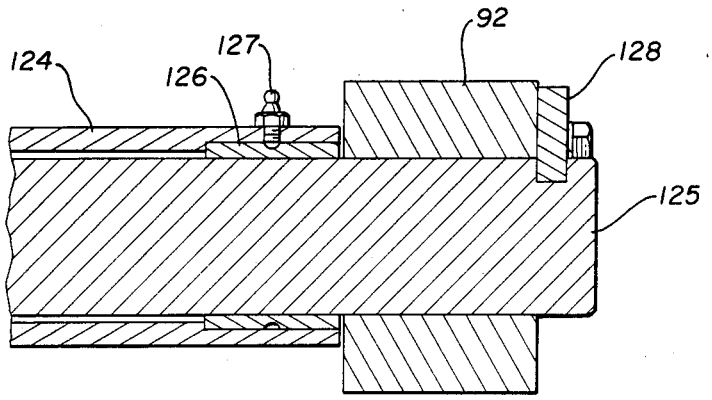
FIG. 5 is a verticle partial sectional view taken on the line 5—5 of FIG. 3.

The means for clamping or grasping new tie, $T_N$, also includes side jaw clamp 56, shown in dotted lines in FIG. 4. The construction of side jaw clamp 56 is similar to lower jaw clamp 55. Side jaw clamp 56 includes a pair of rocker arm side plates 70, which are pivotally mounted on pin 71, which is journalled in collar 72 mounted to plates 73, which are in turn welded to side plate 41 of clamping head assembly 20. Side jaw 56, like lower jaw 55, includes a new tie engaging bar 74, which may, if desired, be provided with teeth to better engage and grip new tie, $T_N$. Side jaw hydraulic cylinder 75 extends through openings in side plates 40 and 41 of clamping head assembly 20, from mounting brackets 76, welded to end plate 77, which is in turn welded to side plates 78 and 79 which are welded to side plate 40 of clamping head assembly 20, to pin 80 between side plates 70 of side jaw rocker arm 56. The operation of hydraulic cylinder 75 thus pivots side jaw 56 about the axis of pin 71, designated the fifth horizontal axis, to thereby move bar 74 into and out of engagement with one side of new tie, $T_N$, to thereby clamp or grip new tie, $T_N$, against side plate 51 of shoe 50 and release it, respectively. Hydraulic cylinders 64 and 65 operate simultaneously in parallel so that both serve to grip or release new tie, $T_N$, against shoe 50, or release it in unison.

The second clamping means for grasping the old tie and the means for pivoting or kicking-out the second clamping means prior to release or discard of the old tie is best understood with reference to FIGS. 3–6 and 2.

Figure 3:
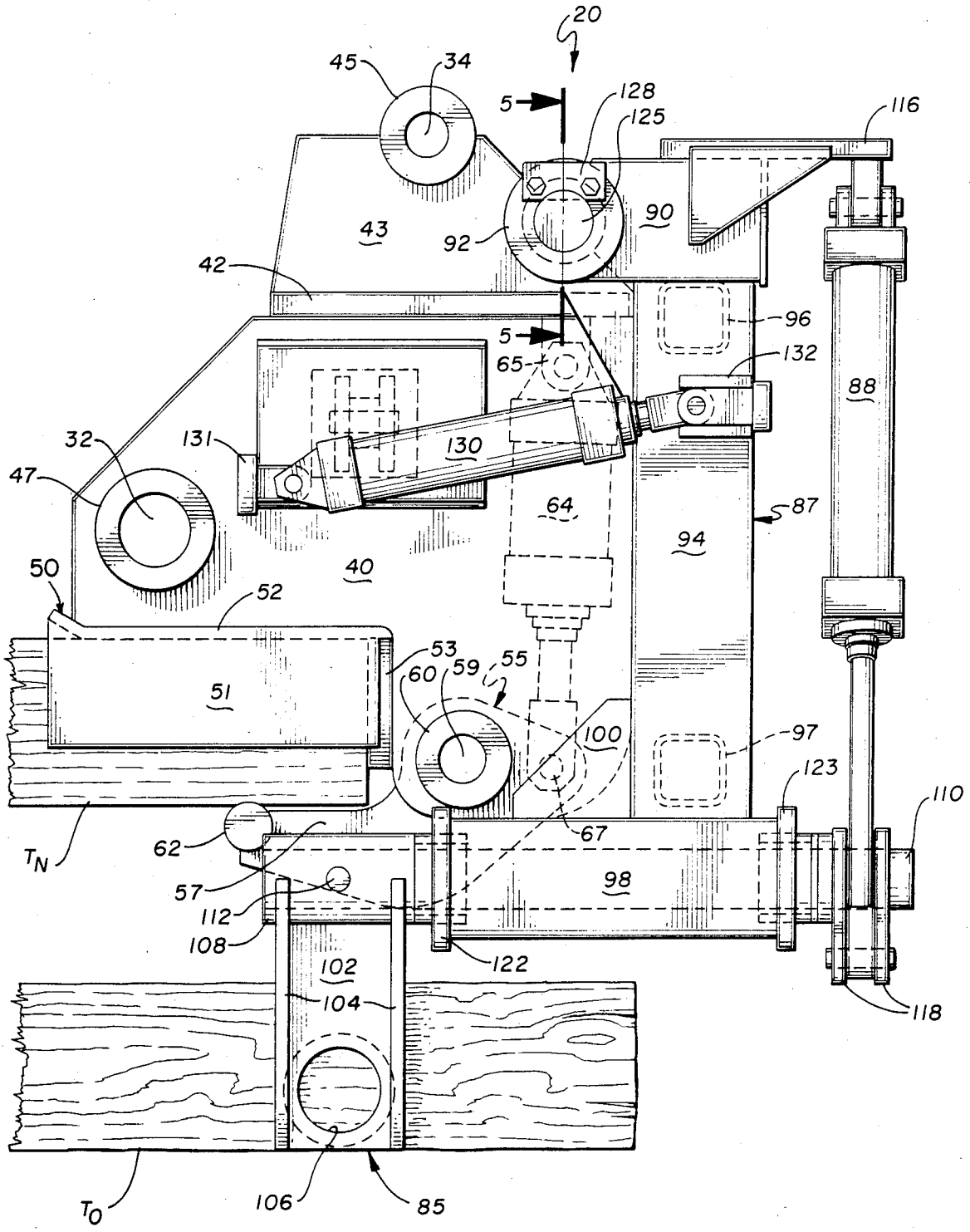
FIG. 3 is a side view of the clamping head assembly simultaneously grasping a new and an old tie.

With reference to FIGS. 3–6, the second clamping means includes as major components opposing wing clamps 85 and 86, mounting frame 87, which is pivotable about a horizontal axis for the kick-out feature as will be explained below, and hydraulic cylinders 88 and 89. Mounting frame 87 is comprised of a series of tubular members, including upper members 90 and 91, which are welded to collars 92 and 93, respectively, vertical side members 94 and 95, cross members 96 and 97, and lower tubular members 98 and 99, all welded together as shown in FIGS. 3 and 4. Gusset plates 100 and 101 reinforce the joint between vertical side members 94 and 95 and lower tubular members 98 and 99, respectively.

Figure 6A:
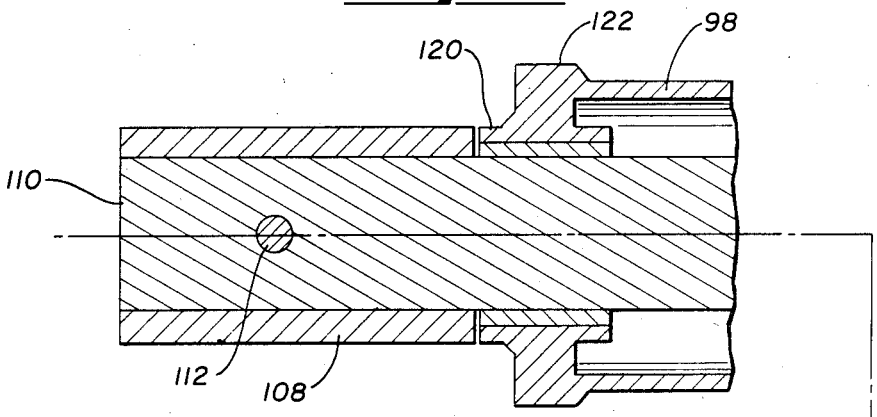
FIGS. 6A and 6B are broken verticle sectional views taken on the line 6—6 of FIG. 4.

Wing clamps 85 and 86, which engage or grip the old tie, $T_O$, as shown in FIGS. 3 and 4, include wing plates 102 and 103, stiffened by stiffeners 104 and 105, respectively, and circular teeth 106 and 107, respectively, which bite into the old tie, as shown in FIG. 4. Wing clamps 85 and 86 are welded to collars 108 and 109. Collars 108 and 109 are pinned for rotation with pins 110 and 111, respectively, by means of pins 112 and 113 as best seen in FIG. 6A. Wing clamps 85 and 86 therefore pivot about the horizontal axis of pins 110 and 111, respectively, as pins 110 and 111 pivot. The axis of pins 110 and 111 are each designated the sixth horizontal axis, the axis of pin 110 is the sixth (right) horizontal axis, and the axis of pin 111 is the sixth (left) horizontal axis.

Figure 2:
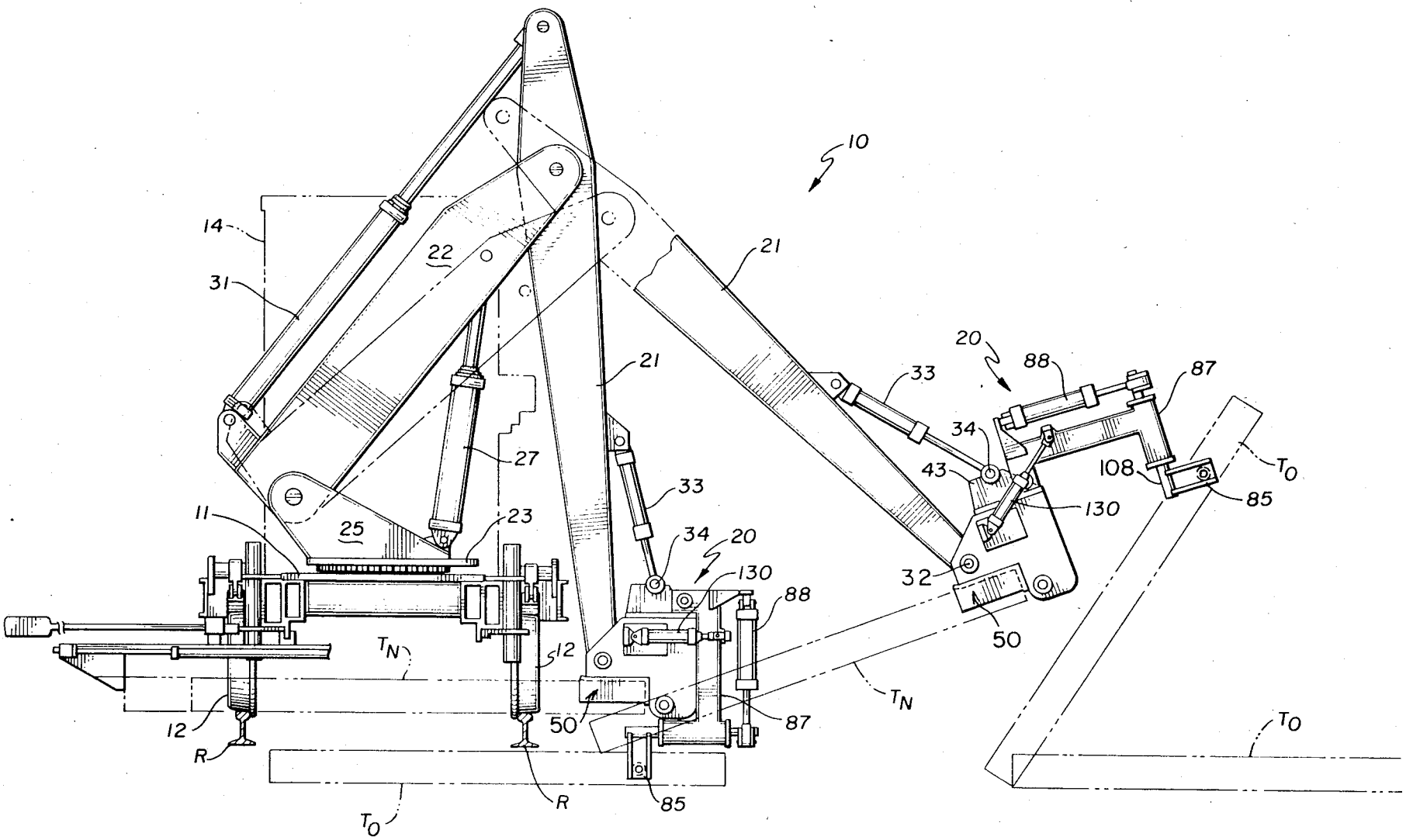
FIG. 2 is a partial front end view of the preferred embodiment of FIG. 1.
Figure 6B:
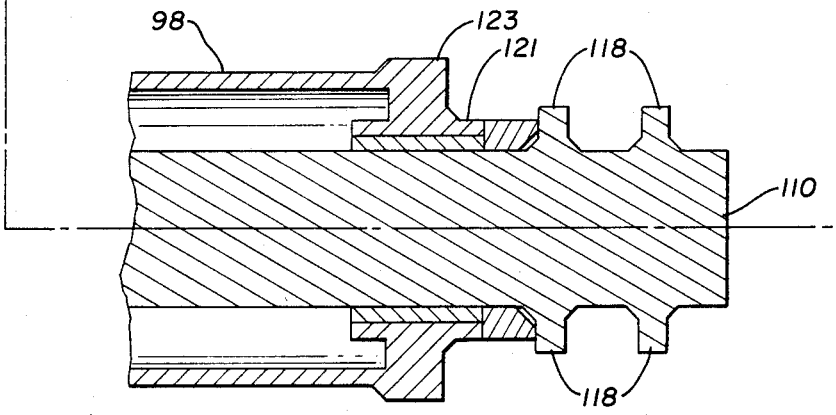

Wing clamps 85 and 86 are caused to pivot into engagement with old tie, $T_O$, as shown in FIGS. 2–4, and out of engagement to release or discard old tie, $T_O$, through the operation of hydraulic cylinders 88 and 89. Cylinders 88 and 89 extend from plates 116 and 117, welded to upper tubular members 90 and 91, respectively, to lever arms 118 and 119, respectively, which are welded, as best seen in FIG. 6B, to pins 110 and 111, respectively. Pins 110 and 111 are each mounted for rotation about their horizontal longitudinal axis by means of collars 120 and 121, which are welded to end plates 122 and 123, which are in turn welded to the opposite ends of tubular members 98 and 99, as shown in FIG. 6. Pins 110 and 111 thus rotate in collars 120 and 121 as hydraulic cylinders 88 and 89 move lever arms 118 and 119, respectively, to operate wing clamps 85 and 86, to grasp and/or release the old tie. For this purpose hydraulic cylinders 88 and 89 operate independently of cylinders 64 and 75, which control the new tie gripping function, so that the old tie can be released without also releasing the new tie.

The mounting frame 87 is mounted to and suspended from gusset plates 43 and 44 by means of sleeve 124 which is welded to gusset plates 43 and 44. Collars 92 and 93, to which the upper tubular members 90 and 91 are welded, are mounted on the opposite ends of pin 125, to thereby mount frame 87 for pivotal movement about the axis of pin 125, designated the seventh horizontal axis, as pin 125 rotates on bushings 126 in sleeve 124, best seen in FIG. 5. A grease fitting 127 is provided to lubricate the interface between sleeve 124 and bushing 126. A key 128 seats in a slot in each end of pin 125 and is bolted to collars 92 and 93 to retain the parts in assembled order.

The means for pivoting or kicking-out frame 87 from the position shown in FIG. 3 to the kicked-out position of FIG. 2, about the axis of pin 125, the seventh horizontal axis, takes the form of hydraulic cylinder 130. Hydraulic cylinder 130 is mounted at its cylinder end to bracket 131, which is fixed to side plate 40 of clamping head assembly 20, and at its piston end to bracket 132, fixed to tubular member 94 of frame 87. Thus the operation of cylinder 130 causes frame 87 to pivot about the axis of pin 125 from the retracted position of FIG. 3 to the extended or kicked-out position shown at the extreme right in FIG. 2.

Operation and Method

The operation of the preferred embodiment and the method of the present invention are as follows.

Tie Exchanger 10 is moved into position above the old tie to be removed, as shown in FIG. 1, and clamping head assembly 20 is positioned above the old tie, $T_O$, near the rail, R, as shown in FIG. 2, through operator selective actuation of boom cylinder 27, jib cylinder 31 and tilt cylinder 33. Shoe 50 is thus seated on new tie, $T_N$, disposed transversely on rail, R, above the old tie, $T_N$, to be replaced, and lower jaw cylinder 64 and side jaw cylinder 75 are actuated to clamp new tie, $T_N$, into secure engagement with shoe 50, thereby putting new tie, $T_N$, in the secure grasp of clamping head assembly 20. Cylinders 88 and 89 are then selectively actuated to operate wing clamps 85 and 86 to thereby grasp the old tie, $T_O$, disposed transversely beneath rail, R. The old tie has been previously loosened and moved along its longitudinal axis to the position shown in FIG. 2. Clamping head assembly 20 thus has both the new tie, $T_N$, and the old tie, $T_O$, simultaneously in its grasp.

Through further selective operation of boom cylinder 27, jib cylinder 31 and tilt cylinder 33, clamping head assembly 20 is moved transversely away from the rails, R, into the position shown in FIG. 1, thereby withdrawing the old tie, $T_O$, from beneath the rails, R, in a path transverse to the rails and substantially along the longitudinal axis of the old tie, $T_O$, while simultaneously grasping and moving the new tie, $T_N$, parallel to and above the path of the old tie, $T_O$.

The old tie can then, if desired, be moved further away from the rails beyond the end of the withdrawal stroke, to thereby kick-out the old tie, through the actuation of kick-out cylinder 130, shown fully extended in FIG. 2 on the extreme right. In this position the old tie is then released or discarded by reverse actuation of cylinders 88 and 89, releasing old tie, $T_O$, from the grasp of wing clamps 85 and 86. Old tie, $T_O$, is thereby discarded a substantial distance from the road bed, well out of the path for inserting a new tie, as shown in FIG. 2, for disposal and/or destruction.

After release or discard of the old tie, and with the new tie in the grasp of clamping head assembly 20, the new tie is inserted in place of the old on the consecutive reciprocal stroke, through reverse operation of boom cylinder 27, jib cylinder 31 and tilt cylinder 33, to thereby complete the cycle or removing old tie, $T_O$, and replace it with a new tie, $T_N$. On the insertion stroke wing clamps 85 and 86 are preferably kept in the fully opened position so they do not extend below lower jaw 55 of clamping head assembly 20, or frame 87 is kept in its kicked-out position for the same purpose. This provides for smoother insertion of the new tie.

Description of Second Embodiment

Figure 7:
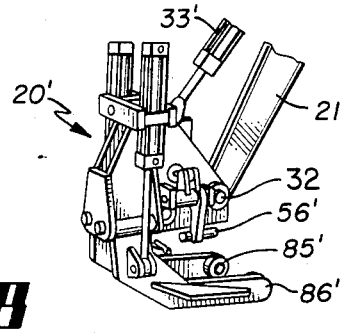
FIGS. 7, 8 and 9 depict a second embodiment that does not include the kick-out feature.
Figure 8:
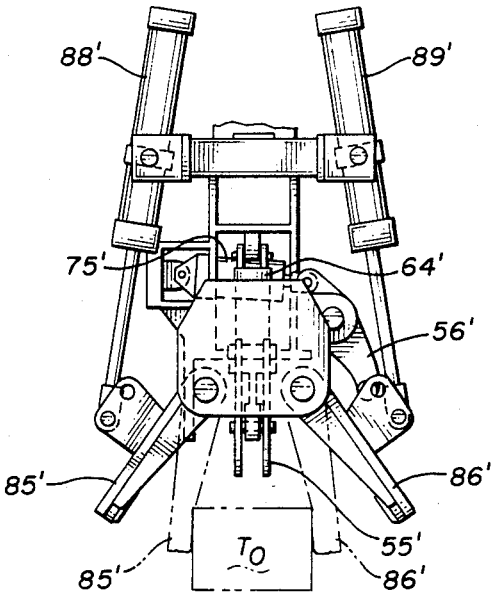
Figure 9:
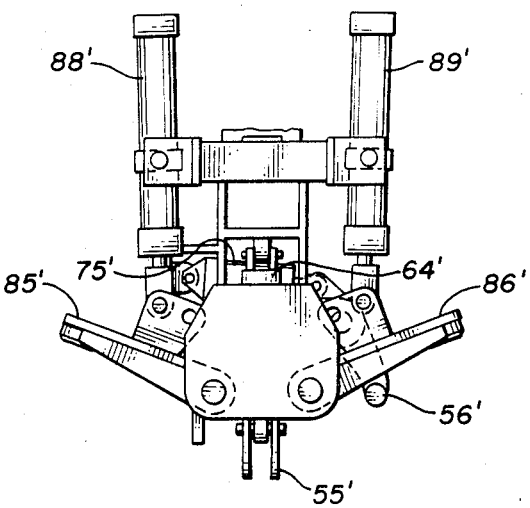

A second embodiment of the invention, without the kick-out feature of the preferred embodiment, is shown in FIGS. 7–9. The embodiment of FIGS. 7–9 includes parts comparable to those shown in FIGS. 1–4 and explained previously, including clamping head assembly 20', jib 21', tilt cylinder 33', lower jaw 55', side jaw 56', lower jaw cylinder 64' and side jaw cylinder 75'. These elements operate as explained in connection with their corresponding parts in the embodiment of FIGS. 1–4, to grasp the new tie.

The means for grasping the old tie in the second embodiment is also similar to the embodiment of FIGS. 1–4, except there is no kick-out feature for the old tie clamping means. The old tie clamping means includes wing clamps 85' and 86' which are actuated by cylinders 88' and 89', respectively. Actuation of cylinders 88' and 89' moves wing clamps 85' and 86' into the position shown in dotted lines in FIG. 8, with the old tie, $T_O$, in grasp, to the open position shown in solid lines in FIG. 8, to release or discard the old tie, $T_O$. In FIG. 9, wing clamps 85' and 86' are fully retracted or withdrawn so they do not extend below lower jaw 55', thereby being out of the way when clamping head assembly 20' is moved into position to insert the new tie in place of the old on the consecutive reciprocal return stroke of the clamping head assembly 20'.

The foregoing describes the design, construction and operation of the preferred embodiment of the present invention, and an alternative embodiment. Variations can be made in the specific configuration of the parts without departing from the spirit or scope of the invention, which is defined by the following claims.

We claim:

1. In railroad right-of-way maintenance apparatus for removing an old tie from beneath parallel rails and inserting a new tie in place of the old, the improvement comprising:

a. a clamping head assembly including:
   (1) first clamping means for grasping a new tie near its end,
   (2) second clamping means disposed beneath said first clamping means for simultaneously grasping the old tie near its end at a point outside the parallel rails;

b. means for moving said clamping head assembly transversely away from the rails in a path substantially along the longitudinal axis of the old tie, to withdraw the old tie from beneath the rails while simultaneously grasping the new tie;

c. means operative independently of said first clamping means to open said second clamping means to release the old tie; and d. means for moving said clamping head assembly and said first clamping means transversely toward and beneath the rails in a path substantially along the longitudinal axis of the new tiew, to insert the new tie beneath the rails to thereby replace the old tie with the new.

2. The apparatus of claim 1 wherein said means for moving said clamping head assembly transversely away from the rails in a path substantially along the longitudinal axis of the old tie comprises:

a. a boom member mounted at one end for pivotal movement about a first horizontal axis;

b. means for pivoting said boom member about said first horizontal axis;

c. a jib member mounted at one end to the other end of said boom member for pivotal movement about a second horizontal axis;

d. means for pivoting said jib member about said second horizontal axis;

e. means mounting said clamping head assembly to the other end of said jib member for pivotal movement about a third horizontal axis; and f. means for pivoting said clamping head assembly about said third horizontal axis.

3. The apparatus of claim 2 wherein said boom member is mounted for pivotal movement about a vertical axis.

4. The apparatus of claim 3 wherein said boom member is mounted on a wheel-mounted frame, and means for moving said wheel-mounted frame over the rails.

5. The apparatus of claim 2 wherein said first clamping means comprises:

a. a shoe member adapted to engage the top and side wall of the new tie;

b. a lower jaw clamp mounted for pivotal movement about a fourth horizontal axis transverse to the longitudinal axis on the new tie;

c. means for pivoting said lower jaw clamp into engagement with the bottom of the new tie, thereby forcing the top of the new tie into engagement with said shoe member;

d. a side jaw clamp mounted for pivotal movement about a fifth horizontal axis parallel to the longitudinal axis of the new tie; and e. means for pivoting said side jaw clamp into engagement with one side wall of the new tie, thereby forcing the other side wall into engagement with said shoe member.

6. The apparatus of claim 5 wherein said second clamping means comprises:

a. a pair of opposing, spaced wing clamps mounted for pivotal movement about a sixth (left) horizontal axis and a sixth (right) horizontal axis parallel to the longitudinal axis of the old tie; and b. means for pivoting said wing clamps toward and away from each other into and out of engagement with the opposite side walls of the old tie to thereby grip and release the old tie, respectively.

7. The apparatus of claim 1 wherein said second clamping means is mounted to said clamping head assembly for pivotal movement about a horizontal axis, and means for pivoting said second clamping means about said horizontal axis, to thereby kick out the old tie before release or discard.

8. The apparatus of claim 3 wherein said first clamping means comprises:

a. a shoe member adapted to engage the top and side wall of the new tie;

b. a lower jaw clamp mounted for pivotal movement about a fourth horizontal axis transverse to the longitudinal axis on the new tie;

c. means for pivoting said lower jaw clamp into engagement with the bottom of the new tie, thereby forcing the top of the new tie into engagement with said shoe member;

d. a side jaw clamp mounted for pivotal movement about a fifth horizontal axis parallel to the longitudinal axis of the new tie; and e. means for pivoting said side jaw clamp into engagement with one side wall of the new tie, thereby forcing the other side wall into engagement with said shoe member.

9. The apparatus of claim 8 wherein said second clamping means comprises:

a. a pair of opposing, spaced wing clamps mounted for pivotal movement about a sixth (left) horizontal axis and a sixth (right) horizontal axis parallel to the longitudinal axis of the old tie; and b. means for pivoting said wing clamps toward and away from each other into and out of engagement with the opposite side walls of the old tie to thereby grip and replace the old tie, respectively.

10. The apparatus of claim 2 wherein said second clamping means is mounted to said clamping head assembly for pivotal movement about a horizontal axis and means for pivoting said second clamping means about said horizontal axis, to thereby kick out the old tie before release or discard.

11. The apparatus of claim 4 wherein said second clamping means is mounted to said clamping head assembly for pivotal movement about a horizontal axis and means for pivoting said second clamping means about said horizontal axis, to thereby kick out the old tie before release or discard.

12. The apparatus of claim 6 wherein said second clamping means is mounted to said clamping head assembly for pivotal movement about a seventh horizontal axis and means for pivoting said second clamping means about said seventh horizontal axis, to thereby kick out the old tie before release or discard.

13. In a method for removing an old tie from beneath parallel rails and inserting a new tie in place of the old, the improvement comprising removing the old tie and inserting the new tie respectively on consecutive reciprocal strokes, including the steps of:

a. simultaneously grasping a new tie near its end and grasping the old tie near its end while disposed below the new tie and transversely beneath the rails;

b. withdrawing the old tie from beneath the rails in a path transverse to the rails and substantially along the longitudinal axis of the old tie, while simultaneously grasping and moving the new tie parallel to and above the path of the old tie;

c. releasing the old tie; and d. inserting the new tie, in a path substantially along the longitudinal axis of the new tie, beneath the rails, on the consecutive reciprocal stroke, to thereby replace the old tie with the new.

14. In a method for removing an old tie from beneath parallel rails and inserting a new tie in place of the old, the improvement comprising removing the old tie and inserting the new tie respectively on consecutive reciprocal strokes, including the steps of:

a. simultaneously grasping a new tie near its end and grasping the old tie near its end while disposed below the new tie and transversely beneath the rails;

b. Withdrawing the old tie from beneath the rails in a path transverse to the rails and substantially along the longitudinal axis of the old tie, while simultaneously grasping and moving the new tie parallel to and above the path of the old tie to thereby define a withdrawal stroke;

c. moving the old tie beyond the end of the withdrawal stroke while holding the new tie stationary, to thereby kick-out the old tie with respect to the end of the withdrawal stroke;

d. releasing the old tie; and e. inserting the new tie, in a path substantially along the longitudinal axis of the new tie, beneath the rails, on the consecutive reciprocal stroke, to thereby replace the old tie with the new.

* * * * *